US005318106A

United States Patent [19]

Dorini et al.

[11] Patent Number: 5,318,106

[45] Date of Patent: Jun. 7, 1994

[54] METHOD AND APPARATUS FOR CONTROLLING THE FLOW OF PROCESS FLUIDS

[76] Inventors: Donald K. Dorini, 1720 SE. 9th St., Ft. Lauderdale, Fla. 33316; Gene D. Krist, 9 Hendricks Isle, Ft. Lauderdale, Fla. 33301; Gerald F. Mannion, 608 Bowling Green Ct., Naperville, Ill. 60540; James R. Mannion, 3811 Hickory La., Oconomowoc, Wis. 53066

[21] Appl. No.: 825,017

[22] Filed: Jan. 24, 1992

Related U.S. Application Data

[63] Continuation-in-part of Ser. No. 464,346, Jan. 12, 1990, Pat. No. 5,089,975.

[51] Int. Cl.[5] ..... F25D 17/02

[52] U.S. Cl. ..... 165/40; 62/185; 62/201

[58] Field of Search ..... 62/201, 185; 236/14, 236/51; 165/40; 237/8 R

[56] References Cited

U.S. PATENT DOCUMENTS

| | | | |
|---|---|---|---|
| 4,497,031 | 1/1985 | Froehling et al. | 165/22 X |
| 4,498,428 | 2/1985 | La Spisa et al. | 236/14 X |
| 4,829,779 | 5/1989 | Munson et al. | 236/51 X |
| 5,104,037 | 4/1992 | Karg et al. | 236/51 X |

*Primary Examiner*—William E. Wayner
*Attorney, Agent, or Firm*—Michael J. Colitz, Jr.

[57] ABSTRACT

A method and apparatus for coupling a primary loop with a secondary loop for circulating processing fluids therebetween comprising in combination a first connection for the feed line of the primary loop and a second connection for the return line of the primary loop; a third connection for the feed line of the secondary loop and a fourth connection for the return line of the secondary loop; a crossover line coupling the four connections; first valve means for controlling the flow through the primary loop; first sensor means responsive to the flow across the crossover line to control the first valve means; second valve means in the path of flow through the crossover line; second sensor means responsive to the temperature of the process fluid in the secondary loop to control the second valve means; a common controller for the first and second sensor means adapted to control the first and second valve means as a function of the sensed temperature and flow; and a common controller for the first and second sensor means adapted to control the first and second valve means as a function of the sensed flow and temperature with means to limit the extent of opening of one of the valve means as a function of the extent of opening of the other of the valve means.

2 Claims, 7 Drawing Sheets

FIG. 3
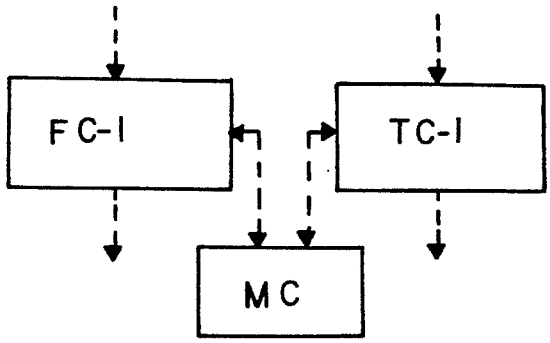
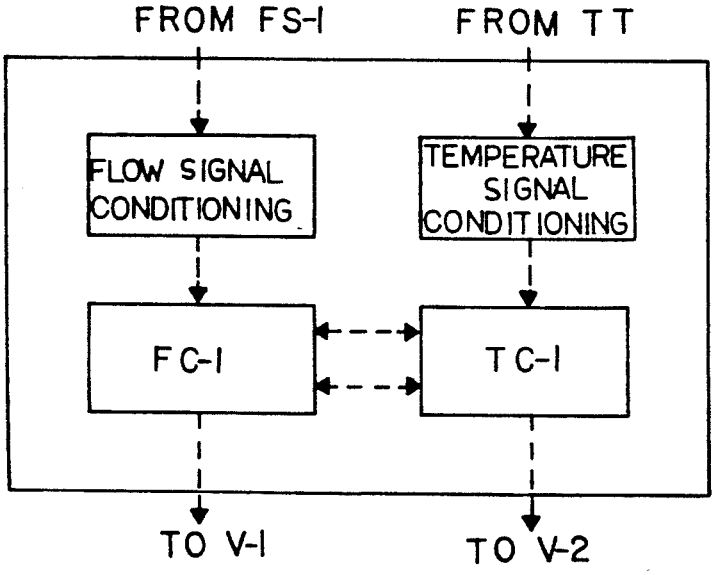
FIG. 4
FIG. 7
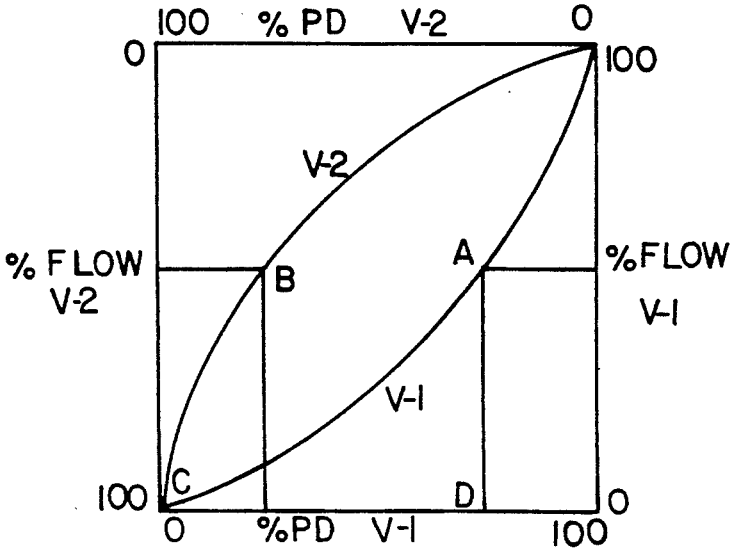

METHOD AND APPARATUS FOR CONTROLLING THE FLOW OF PROCESS FLUIDS

RELATED APPLICATION

This application is a continuation-in-part of U.S. patent application Ser. No. 07/464,346, now U.S. Pat. No. 5,089,975, filed Jan. 12, 1990.

BACKGROUND OF THE INVENTION

1. Field of the Invention

This invention relates to a method and apparatus for controlling the flow of process fluids and, more particularly, to a system for feeding process water in a controlled manner through a primary loop and secondary loops.

2. Description of the Background Art

In the field of flow control systems, one technique for providing chilled process water to a plurality of remote sites is to use a primary flow loop from chillers to the sites where the water is to be utilized, as for air cooling, and then back to the chillers for recycling in a continuous cycle of operation. At the remote sites where the process water is to be used, secondary pumped flow loops tap from, and return to, the primary loop, the chilled water for use in air cooling at each of the various sites. As a result, there is one primary loop in a continuous flow and a plurality of pumped secondary loops for utilizing the water from the primary loop as needed.

In considering any one secondary loop, there will be a section of crossover line which is common with both the primary loop and the secondary loop. The apparatus coupling the primary loop with a secondary loop is a water bridge. A primary pump is used to continuously feed the water through the primary loop. A secondary pump is used to feed the water through each secondary loop but only at a given rate and only when required. Without appropriate controls, however, the system would be very inefficient, chilling and/or feeding more or less water than is needed for the intended air cooling.

In U.S. Pat. No. 3,729,051, the problem of controlling the quantity of flowing water was addressed and solved. According to that patent, a small supplemental water line is placed across the common extent of the primary and each secondary loop. The supplemental line at each secondary loop was of a significantly smaller diameter for a limited flow, merely sufficient to sense a primary flow balance between the primary loop and the flow of the secondary loop.

For optimum efficiency, the flow through the primary loop should equal the flow required to supply the primary flow needs to the total of secondary loops. If insufficient water is pumped in either loop, the intended cooling will not be effected. If excess water is pumped, unnecessary energy will be expended in moving the water. By sensing the flow along the supplemental line, verification may be made that water is flowing and that pressure exists in a supplemental line. So long as the sensed water in the supplemental line remains at the optimum predetermined flow, no change is made to the fluid flow. If, however, the sensed water varies from the predetermined flow, a signal is sent back to a first control valve in the primary loop to restrict the flow and thereby minimize the work done by the pump of the primary loop. This effects a greater efficiency.

In a subsequent improvement, as described in U.S. Pat. No. 3,875,995, temperature is also taken into account for controlling water flow. In the event that the supply or return water in the secondary loop varies from its intended, predetermined temperature, inefficiency results. If the temperature of the water in the secondary loop is not cool enough, the intended air cooling will not be effected. If the temperature of the water in the secondary loop is too cool, excess chilling is being done at an unnecessary cost to the system and its user. As a result, a temperature control sensor is provided. So long as the sensed temperature is at a predetermined value, the chilling simply continues. If, however, the temperature deviates from the predetermined value, the difference is sensed and a signal is sent to a second control valve located in the crossover line of the water bridge to vary the quantity of chilled water provided to the secondary loop to temperature demand of the loop. This feature further increases the efficiency of the system by reducing the primary water to a minimum.

In a further improvement to fluid control systems, as described in the copyrighted BRDG-TNDR Corporation brochure of 1988, the signals generated for temperature and pressure control are fed back from the water bridges of the air cooling subassemblies to the water chiller subassembly to vary the amount of recirculating water being fed through the chiller to thereby modify the temperature and pressure of the water in the primary loop.

A further improvement is described in U.S. Pat. NO. 5,089,975. In its simplest terms, the temperature and flow sensors are replaced with electronic sensors of a size and capability more efficient than those previously known and utilized. Their use generates more accurate readings, and they have less adverse effect on the flow. This further increases the accuracy of readings and provides greater control and efficiency in the system. In addition, each controller is removed from the site of sensing and repositioned in a common electronics package. As such, all electronic controls for each secondary loop are integrated into a common controller for greater overall efficiency. This more readily allows all the controllers for all the secondary loops to be in two-way communication with each other and/or a common host computer for integration of the system. As such, the efficiencies effected to the system are greater than the sum of the efficiencies of the individual water bridges.

A further improvement is described in U.S. Pat. No. 5,138,845. According to that disclosure, sensor means are provided at each water bridge to determine the operating characteristics of the system, present and historical, and to integrate such information at a master controller for modifying the operating characteristics of the control mechanisms at the various individual water bridges.

As referred to above, the prior art discloses systems for controlling the flow of process fluids. Nothing in the prior art, however, controls the flow with the simplicity, accuracy and efficiency afforded by the present invention.

Therefore, it is an object of this invention to provide a method and apparatus which overcomes the aforementioned shortcomings and which is a significant contribution to the advancement of the arts.

It is a further object of the present invention to control the limits of openness of one of the valves of any water bridge as a function of the extent of openness of the other of the valves at such water bridge.

It is a further object of the present invention to control each site of a water bridge system independently of all other sites of such system.

It is an object of the present invention to employ at each water bridge of a system, a common control with a first component coupling a first sensor and valve, a second component coupling a second sensor and second valve, and a supplemental component to couple the first and second components to vary the operation of the first and second components, as a function of the specific application of the system.

Lastly, it is an object of the present invention to provide an improved method and apparatus for coupling a primary loop with a secondary loop for circulating processing fluids therebetween comprising in combination a first connection for the feed line of the primary loop and a second connection for the return line of the primary loop; a third connection for the feed line of the secondary loop and a fourth connection for the return line of the secondary loop: a crossover line coupling the four connections; first valve means for controlling the flow through the primary loop; first sensor means responsive to the flow across the crossover line to control the first valve means; second valve means in the path of flow through the crossover line; second sensor means responsive to the temperature of the process fluid in the secondary loop to control the second valve means; a common controller for the first and second sensor means adapted to control the first and second valve means as a function of the sensed temperature and flow; and a common controller for the first and second sensor means adapted to control the first and second valve means as a function of the sensed flow and temperature with means to limit the extent of opening of one of the valve means as a function of the extent of opening of the other of the valve means.

The foregoing has outlined some of the more pertinent objects of the invention. These objects should be construed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The present invention is defined by the appended claims with the specific embodiment shown in the attached drawings. For the purpose of summarizing the invention, the invention may be incorporated into apparatus for coupling a primary loop with a secondary loop for circulating processing fluids therebetween comprising in combination a first connection for the feed line of the primary loop and a second connection for the return line of the primary loop; a third connection for the feed line of the secondary loop and a fourth connection for the return line of the secondary loop; a crossover line coupling the four connections; first valve means for controlling the flow through the primary loop; first sensor means responsive to the flow across the crossover line to control the first valve means; second valve means in the path of flow through the crossover line; second sensor means responsive to the temperature of the process fluid in the secondary loop to control the second valve means; a common controller for the first and second sensor means adapted to control the first and second valve means as a function of the sensed temperature and flow; and a common controller for the first and second sensor means adapted to control the first and second valve means as a function of the sensed flow and temperature with means to limit the extent of opening of one of the valve means as a function of the extent of opening of the other of the valve means.

The invention may also be incorporated into a method of cooling a flow of air at a plurality of sites comprising the steps of providing a process water chiller subassembly; providing a plurality of air cooling subassemblies; feeding a flow of process water in a primary loop extending between the process water subassembly and the plurality of air cooling subassemblies; effecting a flow of air to be cooled across the secondary loops at the sites to be cooled; providing a plurality of water bridges, each coupling the primary loop with a secondary loop, each water bridge having feed and return connections coupled to the feed and return lines of the primary loop and feed and return connections coupling feed and return lines of a secondary loop, and a crossover line coupling the primary and secondary loops; sensing the flow in each waterbridge crossover line; varying a valve in the path of flow through the primary loop in response to the sensed flow; sensing the temperature of the process water in the secondary loop; varying a temperature responsive valve in the crossover line in response to the sensed temperature; providing a common controller for each water bridge for modifying the valves as a function of the sensed temperature and pressure; and setting the controller of at least one site to limit the extent of openness of one valve of such site as a function of the openness of the other valve of such site.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific embodiments may be readily utilized as a basis for modifying or designing other methods and structures for carrying out the same purposes of the present invention. It should also be realized by those skilled in the art that such equivalent methods and structures do not depart from the spirit and scope of the invention as set forth in the appended claims.

BRIEF DESCRIPTION OF THE DRAWINGS

For a fuller understanding of the nature and objects of the invention, reference should be had to the following detailed description taken in conjunction with the accompanying drawings in which:

FIG. 3 is an enlarged schematic representation of the controller of FIG. 5.

FIG. 4 is an enlarged schematic representation of the controller constructed in accordance with an alternate embodiment of the invention.

FIG. 7 is a diagram of alternate pressures, temperatures, and operating parameters as effected by different settings of the controllers.

Similar reference numerals refer to similar parts throughout the various drawings.

DETAILED DESCRIPTION OF THE INVENTION

Overview

Figure 1:
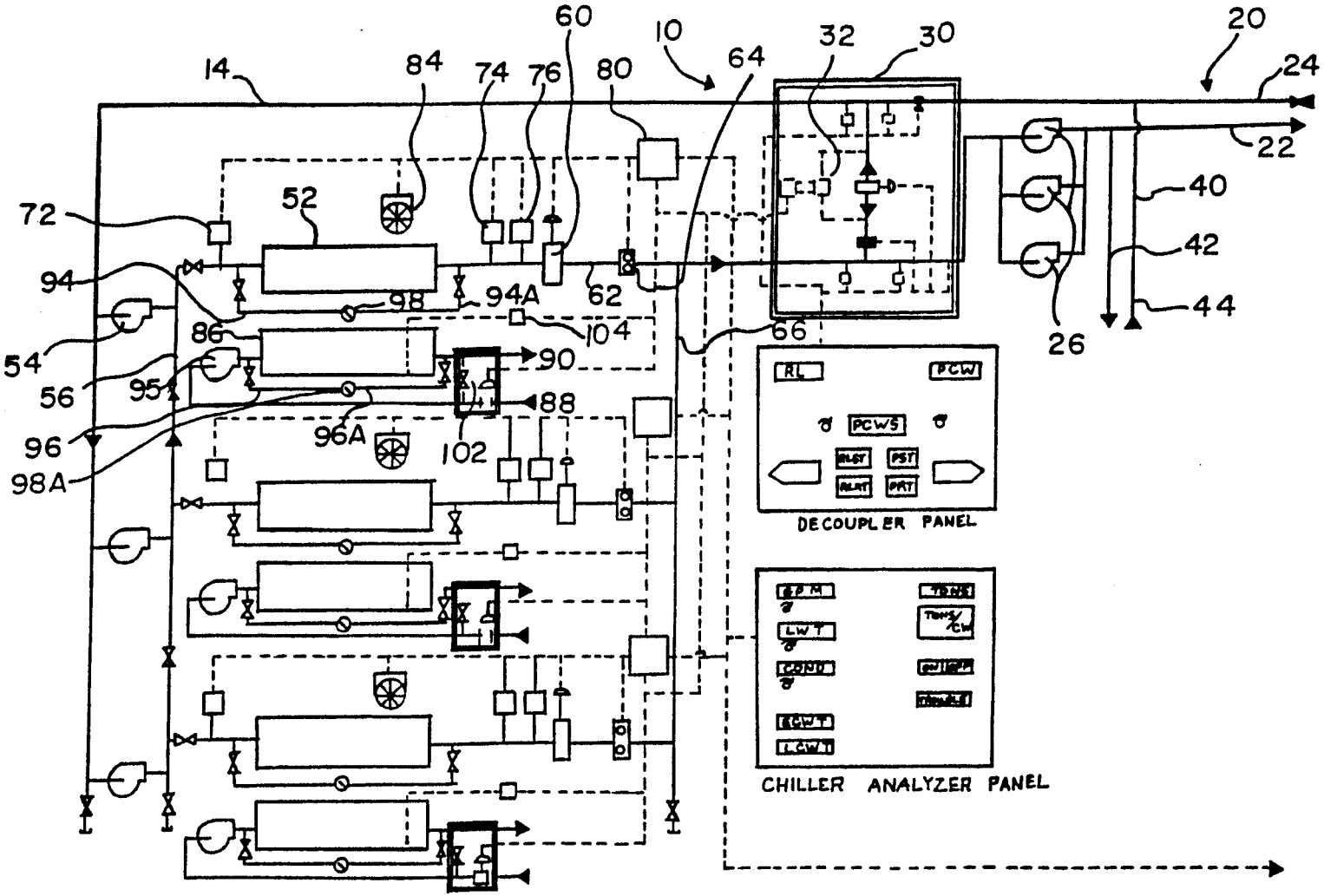
FIG. 1 PRIOR ART
FIG. 1 and FIG. 1A together constitute a schematic illustration of a known fluid control system, the water chiller subsystem being shown in FIG. 1 and the air cooler subsystem being shown in FIG. 1A.
Figure 1A:
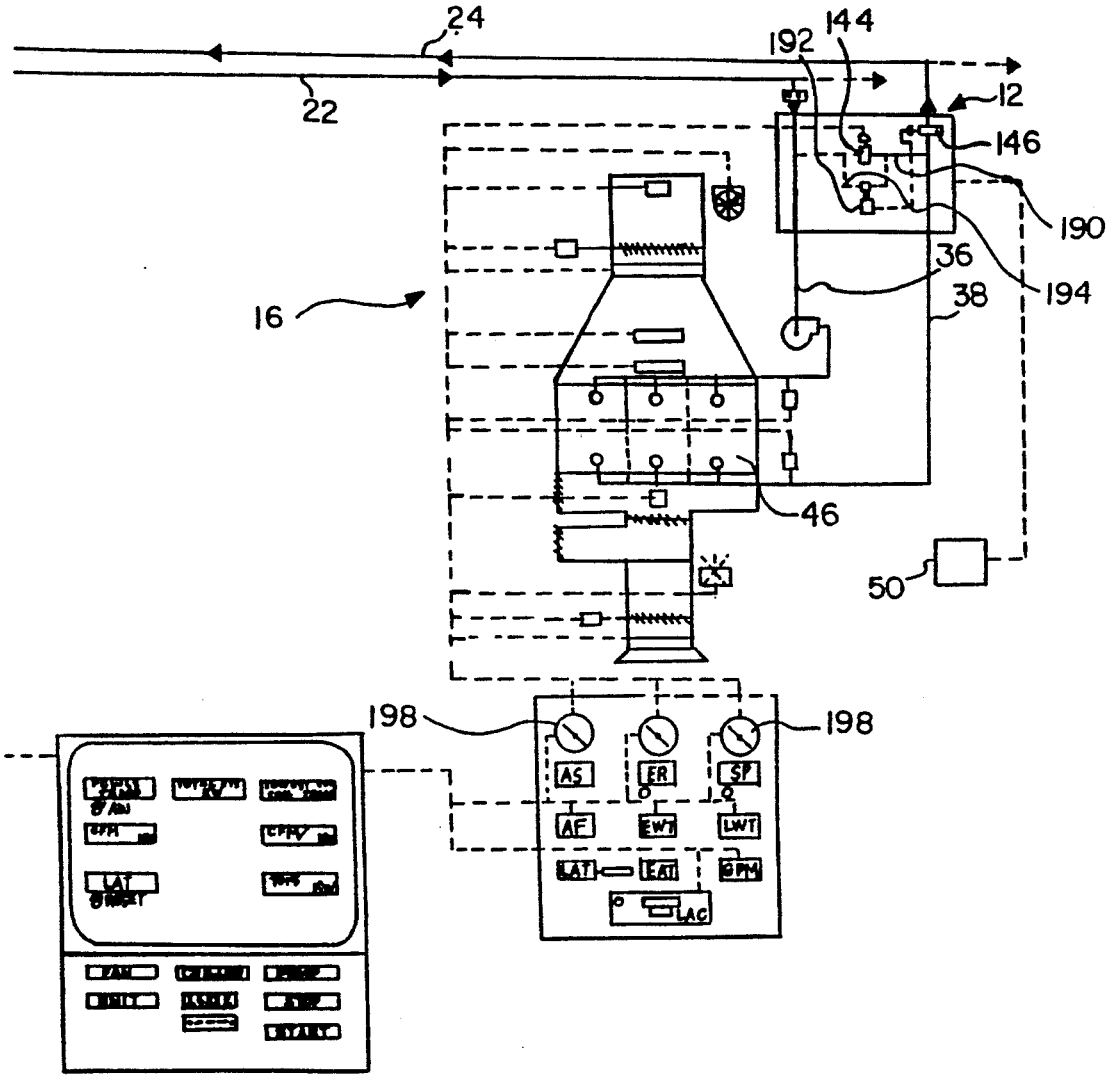
FIG. 1A PRIOR ART

FIGS. 1 and 1A, when taken together, represent a schematic overview of a system 10 employing the water bridge 12 and control elements of the present invention. The FIG. 1 components are generally directed to the subsystem 14 for chilling the process fluid such as water to be utilized. FIG. 1A illustrates the components of the subsystem 16 wherein the chilled water is utilized as for air cooling purposes. The two subsystems are coupled by a common primary loop 20 including feed and return lines 22, 24. Also coupling the two subsystems are auxiliary feed water transfer pumps 26 along with a fluid flow decoupler assembly 30 in advance of the booster pumps. Such fluid flow decoupler assembly 30 includes a water bridge 32 being of the type described in the aforementioned '051 patent.

Figure 2:
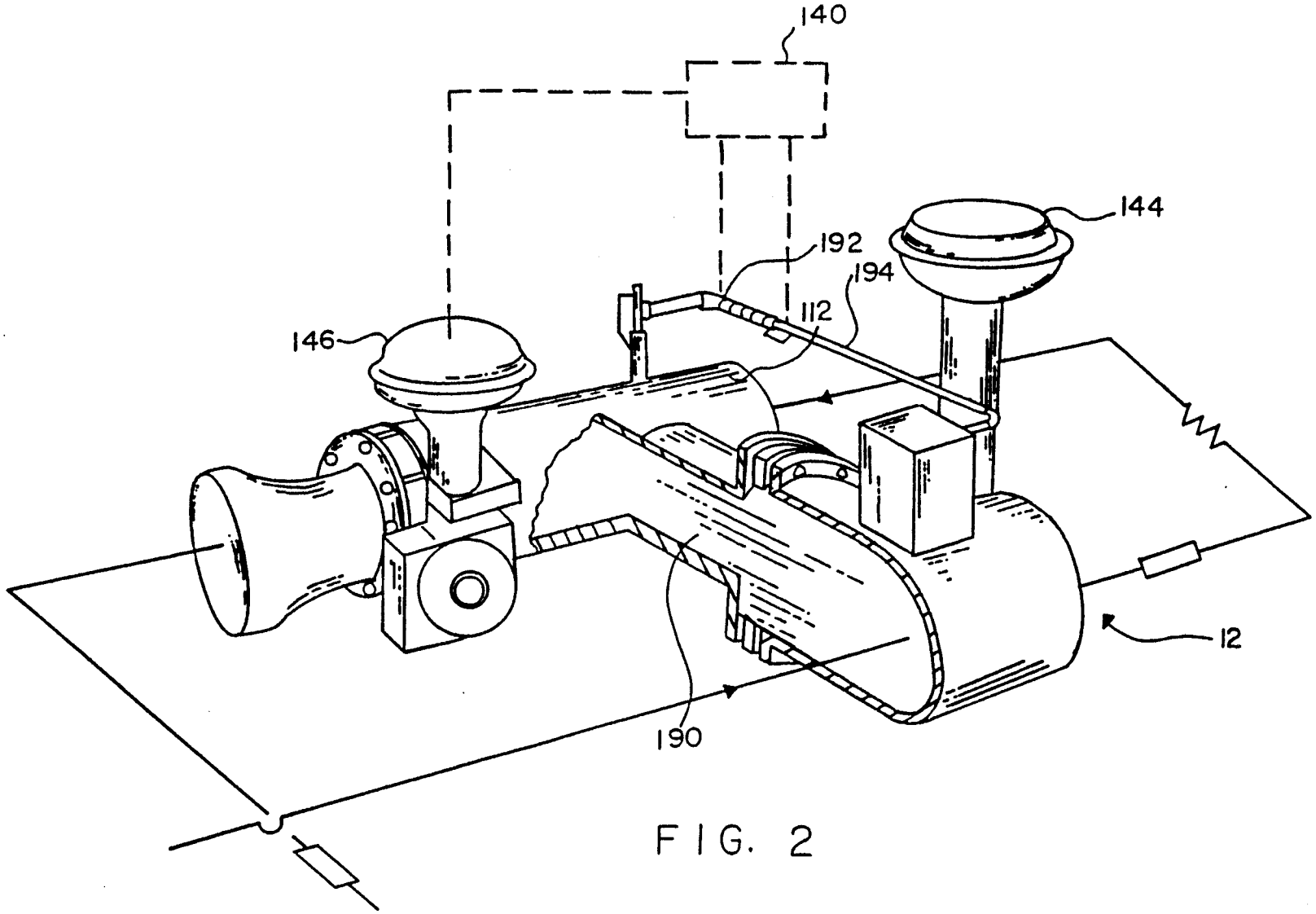
FIG. 2 is a perspective illustration of the water bridge which is shown schematically in the upper right-hand corner of FIG 1A.

FIG. 1A shows the components for utilizing the chilled process water and includes a water bridge 12 coupling the lines of the primary loop 20 with the feed and return lines 36, 38 of one illustrative secondary loop 40. The water bridge 12 is more specifically described hereinafter and can be seen in the mechanical perspective illustration and the electrical schematic of FIGS. 2 and 3. FIG. 1 also illustrates supplemental lines 42, 44 of the primary loop 20 for conveying the process water to sites other than the shown site 46 whereat it may be tapped through any number of additional water bridges for secondary loops for utilization at such additional sites other than that as shown in FIG. 1A.

Also shown in FIG. 1, as well as FIG. 1A, are a plurality of panels for monitoring and controlling the operation of the system 10. These panels include the decoupler panel, the chiller analyzer panel, the air flow control panel, and the system analyzer panel.

Water Chiller Subsystem

The FIG. 1 showing illustrates in detail a typical chiller subsystem 14. Any number of individual chillers 52 might be used in the chiller subsystem. FIG. 1 illustrates three chillers, each with its own accompanying support elements. It should be understood, however, that one or any number might be used in parallel or series similar to the way the three such chillers are illustrated. For the sake of convenience only one chiller and its associated support elements will be described herein.

The chiller 52 has an input end to receive recirculating process water from the return line 24 of the primary loop 20. A chiller pump 54 taps a preselected quantity of process water from the return line and feed it to an intermediate input line 56 coupling the inputs of the various chillers of the subsystem. A line extends through the chiller to its output end and constitutes a separate chiller loop at the starting point of the primary loop. A flow control valve 60 is positioned in the output line 62 of the chiller. The control valve is followed by a flow transducer 64, a flow meter and transmitter, prior to coupling in the output of the other chillers through an output mixing line 66. Thereafter the chiller output is fed through the water bridge 32 of the decoupler assembly 30 followed by the transport or booster pumps 26. This water bridge 32 is of the type disclosed in the aforementioned '051 patent. Temperature sensors 72, 74, 76 are located to determine the chiller entering water temperature as well as the chiller leaving water temperature and feed such information to the controller 80. The output of a flow transducer 64 is also fed to the controller 80. The controller 80 acts to vary the flow control valve 60 in order to maintain the flow rate at a proper level for the intended function. The output of the controller is also fed to the chiller analyzer panel as well as the system analyzer panel for monitoring and controlling the performance of the system overall.

Operating in association with each chiller 52 is an associated condenser 86. The condenser 86 receives and disseminates water to and from a tower, not shown, through feed and return lines 88, 90, the force being provided by a condenser pump 95. A compressor 84 thermally couples the chiller and condenser. Pressure transfer lines 96, 96*a* from the input and output of the condenser 86 feed a flow indicating switch 98*a*. A condenser valve 102, in the nature of that in the water bridge, is coupled between the tower and the condenser for monitoring and controlling the temperature or flow of the water through the condenser. A pressure transmitter controller 104 is located between the condenser and flow controller to sense the pressure in the condenser and to feed its output to the flow controller for control of the condenser valve.

The foregoing sets forth the elements by which the process water of the system is chilled, monitored, and controlled for providing water to the transport primary loop 20 for use by the secondary loop 40. The present invention functions without the integrated controls between the water chilling subassembly and the individual water bridges.

Water Bridge

The bridge for fluid, preferably water, is a device positionable to couple the feed and return lines of the primary transport loop 20 with the input return lines of the secondary loop 40. A common crossover line 190 couples these two loops. Primary pump 26 feeds the process water through the primary transport loop. A secondary pump 116 feeds the process fluid through the secondary loop as needed. In those conditions when it is not desired for the secondary loop to function for its air cooling purposes, the secondary pump is inactivated. This closes the crossover conductor line 190. Because the cooling pump is shut down, valve 146 senses no demand for cooling and closes. This response stops unnecessary bypass flow through the secondary loop when not required. The constantly operating pump of the primary loop feeds small quantities of process fluid through a supplemental line 194, passing a sensor 192, from supply to return with no bypass through the secondary loop or crossover conduit 190. When, however, it is desirous to utilize the secondary loop for its cooling function, the secondary pump 116 is activated so that a flow of process fluid is created to the secondary loop. The first or pressure responsive valve 146 (V-1) is located in the water bridge adjacent the return line of the primary loop. This pressure valve is available to control the total flow of fluid through the primary loop to meet the demand needs of the secondary loop.

The pressure valve 146 is opened or closed to any extent as a function of the pressure drop across the crossover line 190. This is effected through a sensor 192 coupled with respect to the crossover line preferably in association with an additional smaller supplemental line 194 coupling the ends of the crossover line 190 in parallel therewith to effect a significantly lesser, but proportional, flow and pressure through the supplemental line 194 as compared with the larger flow through the crossover line. The detected pressure correlates directly to the fluid flow across the cross-over line which, through the controls located at the supplemental line, open or close the pressure valve proportionately for effecting the proper fluid flow through the primary loop.

A second or temperature responsive valve 144 (V-2) is located intermediate the ends of the supplemental crossover lines. Like the first valve, the second valve is variable to proportionately restrict the flow of fluid, but through the crossover line. This valve is controlled through the controller with its temperature sensor located at any one of a plurality of predetermined points such as in the airflow at the output of the cooling tubes at the input to the secondary loop shown as sensor or at the output of the secondary loop shown as sensor. So long as the temperature is within a predetermined range, the valve will not vary. Once, however, its sensor detects a change from the desired temperature, this information is fed to the controller for increasing or opening or closing the temperature responsive valve appropriately.

In operation and use, when a secondary loop 40 requires little or no cooling power from the processing fluid, such pressure will be noticed through the flow sensor and the pressure valve 146 will close an appropriate amount to restrict the flow of the process fluid through the primary loop 20 and thereby minimize power usage on the pumps and on the chillers. When, however, usage by the secondary loops 40 is increased, additional processing fluid and chilling will be required. This information will be fed back and the pressure valve will open an appropriate amount as determined through the controller.

In a correlated manner, when the temperature of the process water of the secondary loop becomes excessively cool, or the process water in the secondary loop 40 becomes acceptably cool, a temperature valve 144 will open appropriately to restrict its use and also signal the decoupler assembly 30 to recirculate and use less chilled process water. Conversely, if the air or other sensor temperature becomes too warm, the temperature valve will close and the chilled process water will flow in greater quantities to effect the desired increased chilling.

Water Bridge Controls

In the prior art water bridges, the sensors for temperature and flow were appropriately located in the area where sensing was to occur. The controller for the temperature sensor was located at the temperature sensor while the controller for the flow sensor was located adjacent to its associated valve. In such prior art water bridge systems, each controller, one for each sensor, was set and controlled independent of all other controllers. In later systems, as for example, those of the type described in the aforementioned parent patent application of which this is a continuation in part, the controllers at any one water bridge were integrated into a single common controller while such common controllers for the various bridges were operatively coupled together through a host computer to coordinate control between the controllers and stations.

In accordance with the present invention, the controller for each water bridge 12 is a common controller unit 140 located preferably at the crossover line 190. The controller of the water bridge is coupled to its remote sensors with the flow signal conditioner built integral with its controller. Each controller 140 functions independently of all other controllers of the system.

In the past TC-1 and FC-1 were independent controllers receiving signals from their respective sensors FS-1 and TT and controlling there respective controlled devices V-1 and V-2. The only feedback between the two control systems was through the ebb and flow of the hydraulic fluid system the two controllers were attempting to monitor and control. Under most conditions this method of control worked well. Circumstances, however, sometimes occurred that would upset the normal operation of hydraulically linked system. Some of the causes for system upset are improper sizing of controlled devices V-1 and V-2, unstable signal from input TT, changes in system characteristics from design to actual operation, flow variation in the secondary loop and radical changes in fluid flow availability from the primary loop.

Further intelligence is provided to the common controller of each station, independent of all other stations, by the inclusion of an additional or third component to the controller. Such additional component couples the conventional first two controller components, i.e. the temperature controller component and the flow controller component which continue to function for modifying the temperature responsive valve and flow responsive valve. Furthermore, the additional component allows the controllers to communicate with each other. The response of each controller is based on each individual controller's sensing device as well as the response generated by other controller's located at other stations. (See FIG. 3). An additional benefit of adding the third component is that operating parameters and characteristics of each station may be controlled autonomously and independent of all other stations of the system in accordance with the specific needs of such station thereby eliminating the need for a host computer.

In practice, two controllers, the input signal conditioning for their field sensing devices, and the master controller reside in the same microprocessor (See FIG. 4). One controller TC-1 controls the temperature for the secondary loop and/or the load. One controller FC-1 controls the flow of the primary fluid into the secondary circuit. The input conditioning for FS-1 provides damping, ramping and amplification. The signal conditioning for TT provides damping and averaging. These control functions were independent of one another in the past. Now they are linked with one another in the single microprocessor.

Having the controller FC-1 and TC-1 and the signal conditioning for FS-1 and TT reside in a single microprocessor with the communication and memory capabilities as described above overcomes the aforementioned problems.

The microprocessor MC-1 contains sufficient memory to record events such as V-1 and V-2 Valve curve characteristics, V-1 and V-2 stroke limits, TC-1 and FC-1 setpoints, preconfigured control algorithms and control outputs. The microprocessor MC-1 contains sufficient dynamic memory to record the frequency and amplitude of set-point deviation for TC-1 and FC-1. An event marker in the microprocessor will trigger recording of dynamic events when a predetermined deviation from set-point for TC-1 and FC-1 is noted. The recorded events shall include but not be limited to: set points from TC-1 and FC-1, valve position for V-1 and V-2, control algorithm for TC-1 and FC-1, ramping and amplification factors for FC-1 input, stroke limits for V-1 and V-2, amplitude and frequency of deviation from set point for FC-1 and TC-1. All this data will be retained in battery backed memory. The data can then be retrieved and examined at the local microprocessor or downloaded to a host computer. This would allow an operator to redefine as necessary the control algorithms, set points, limits, amplification, damping and ramping to create stable and precise system operation.

Figure 5:
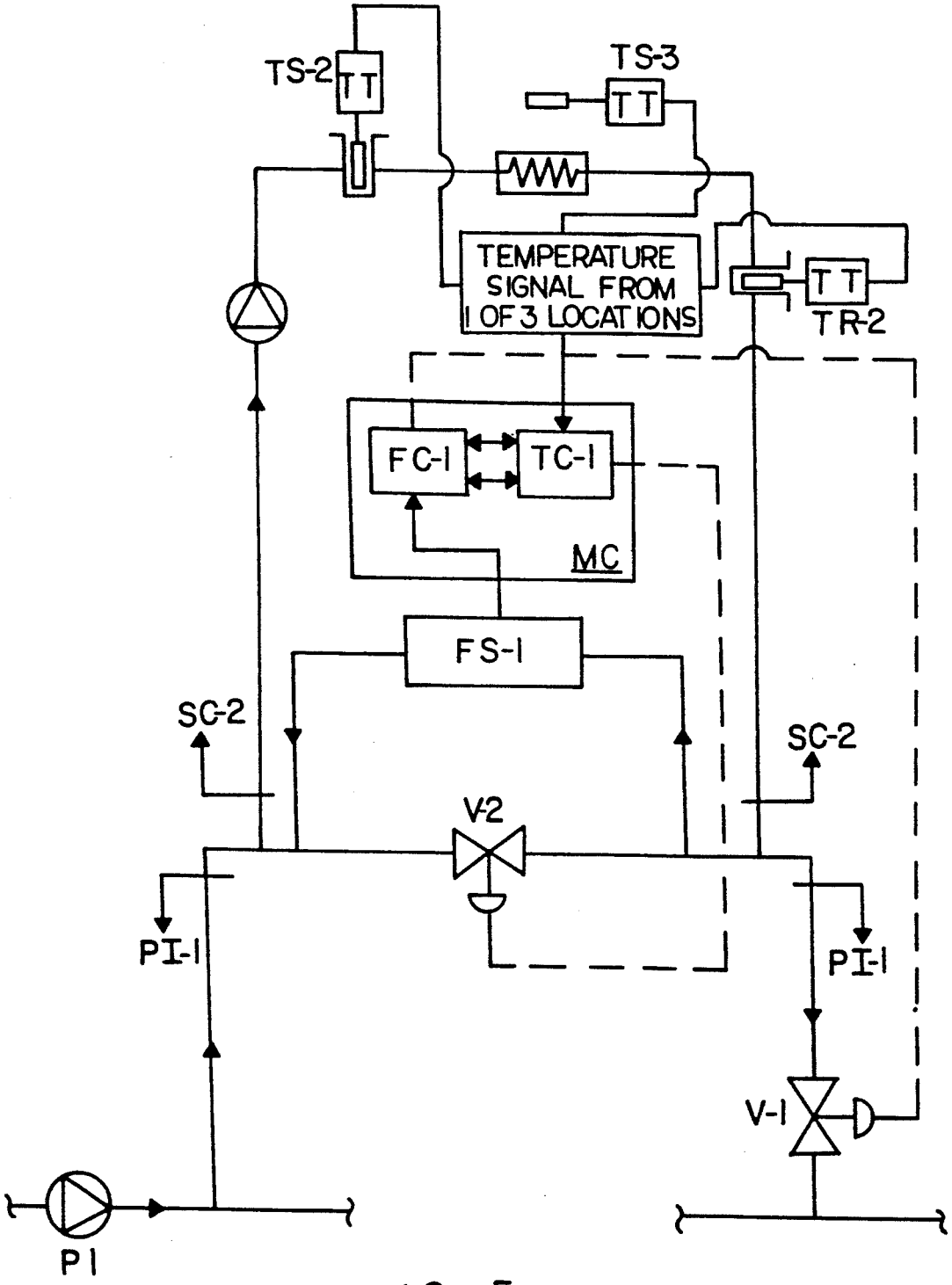
FIG. 5 is a schematic representation of the water bridge which is shown in FIG. 2.

Now that the general characteristics of the microprocessor have been described, the application of the microprocessor to a water bridge control system can be set forth. (See FIG. 5). One portion of the microprocessor called T/C-1 is responsible for maintaining a predetermined setpoint for the control of the temperature delivered by the secondary circuit as measured in one of three locations; secondary supply water (TS-2), secondary return water (TR-2) or load discharge air temperature (TS-3). These are noted as TT in FIG. 5. One portion of the microprocessor 140 (FC-1) is responsible for maintaining a flow balance between the primary system interface (PI-1) and the secondary circuit (SC-2). This is accomplished by sensing a pilot flow as described in the aforementioned parent patent. The two controllers communicate with one another and with their respective controlled devices V-1 and V-2 to provide a complete synchronized control system.

Flow control, FC-1, provides a setpoint control output for control device V-1 in response to a signal from FS-1 flow sensor. Controlled device V-1 provides position feedback to controller FC-1. Temperature control, TC-1, provides a setpoint control output for control device V-2 in response to a signal from temperature sensor TT (TS-2, TR-2, or TS-3). Controlled Device V-2 provides a position feedback to controller TC-1. FC-1 controller provides communication with controller TC-1 and TC-1 controller provides communication with FC-1.

The microprocessor for FC-1 and TC-1 knows the position of V-1, the signal to V-1, the position of V-2, the signal to V-2, the set point of FC-1, the setpoint of TC-1, the input from flow sensor FS-1, the input from temperature sensor TT (TS-2, TR-2 or TS-3,), the speed of response for TC-1, the speed of response for FC-1, the deviation from setpoint, frequency of deviation and magnitude of deviation for flow control FC-1 and temperature control TC-1. The microprocessor is capable of computing variable ramping, variable damping and positive and negative amplification for the signals from FS-1. This is a necessary improvement over BT-1 and BT-2. It allows stabilization of control at the primary/-secondary interchange. This is fundamental to system control. The microprocessor is capable of computing an input damping and averaging for the TT signal to allow for a stable control point.

The microprocessor provides limits for the signal to V-1. This can compensate for the oversizing of V-1 and for changes in system characteristics. These limits are also necessary to assure that primary fluid flow is available when and only when it is needed for setpoint control for the secondary circuit. This is accomplished as follows. Under normal operation the flow control portion of the processor, FC-1 will follow its prescribed setpoint and match it to the input signal from FS-1 by positioning controlled device V-1. This normal operation can be overridden under the following circumstances: (A) If controlled device V-2 is in the fully closed position, controlled device V-1 will be limited and will only be allowed to open to a predetermined position; (B) If controlled device V-2 is in the fully open position, controlled device V-1 will be limited and will be forced to close to a predetermined position.

The microprocessor also provides limits for the signal to V-2. This can compensate for the oversizing of V-2 and for changes in system characteristics.

The microprocessor is capable of sensing system oscillation. It has established limits for the frequency and amplitude of V-1 and V-2 oscillations. When these limits are reached, FC-1 will be provide a predetermined position signal to controlled device V-1. Controlled device V-1 will hold this position until the oscillation is eliminated. Once the system shows acceptable stability FC-1 will revert back to normal setpoint control.

One of the preferred parameters for modifying and controlling each station is the extent or percent of openness of the valves for varying the flow and pressure of the operating fluid through each primary and secondary loop. When, for example, flow control valve is fully open to 100 percent of openness, a maximum flow occurs through the primary loop at the location of the valve, and fully closed to zero percent of openness, no fluid flows through the primary loop at the location of the valve. When the temperature responsive valve is fully 100 percent open, there will be a maximum degree of recirculation or blending of the process water of the two loops, and when the temperature responsive valve is fully closed, there will be no recirculation and hence a maximum flow of fully cooled water through the load from the primary loop.

It has been found, however, that certain intermediate operating parameters should be followed nearly universally within any system. Specifically, it has been found that when one of the valves is fully closed, the other should not be fully closed. Conversely, when one of the valves is fully opened, the other of the valves should not be fully opened. Another operating parameter is that the percent of openness of one of the values varies, the minimum or maximum percent of openness of the other values varies in response thereto.

Figure 6:
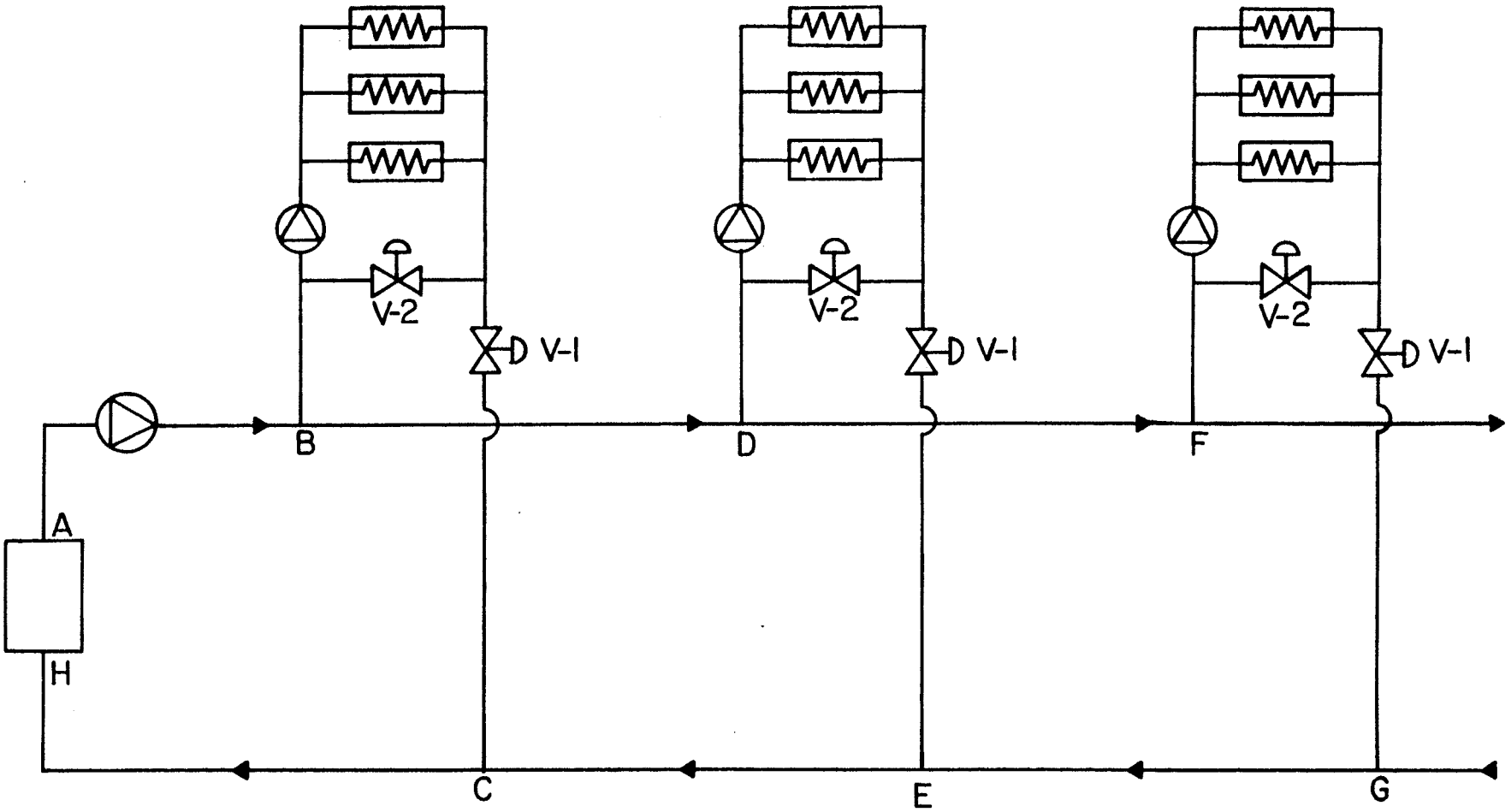
FIG. 6 is a schematic illustration illustrating a plurality of stations with their controllers in an operating embodiment.
Figure 8:
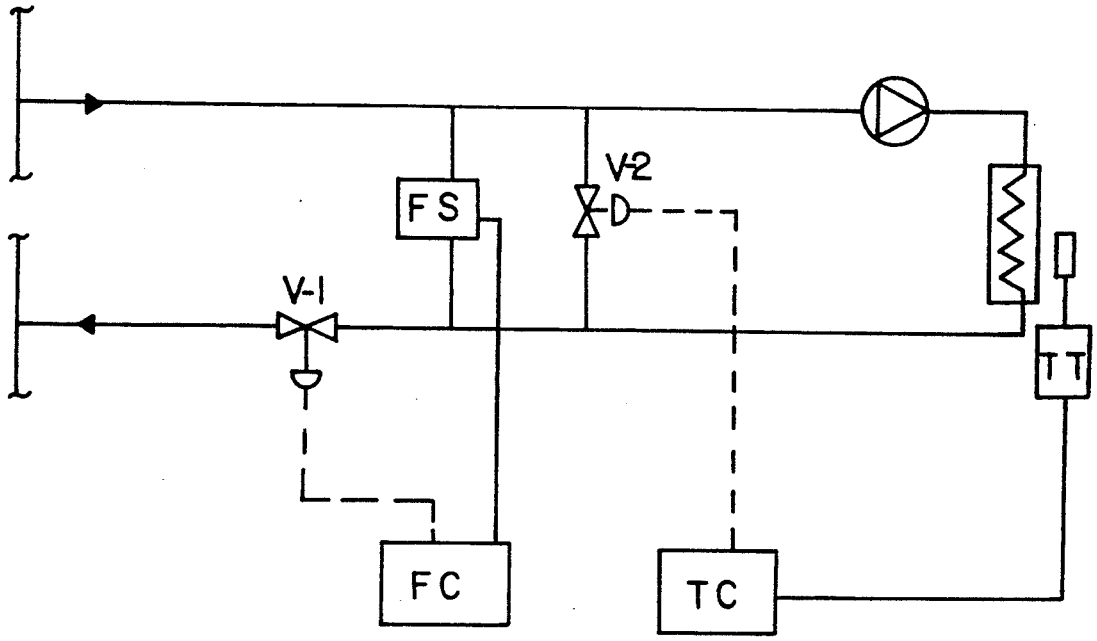
FIG. 8 PRIOR ART
FIGS. 8 and 9 illustrate the control relationship between the prior art and the present invention.
Figure 9:
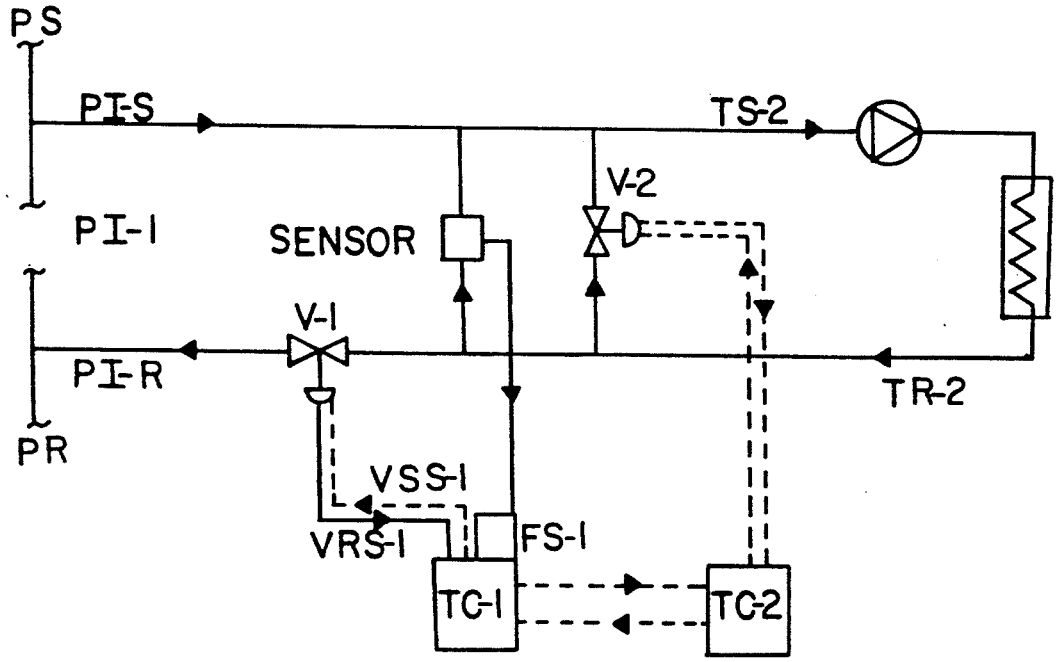

Further, each individual station along a primary path of the system has its own operating parameters even though the end result or degree of cooling at the various load sites is intended to be the same. This is because the characteristics, temperature and pressure, of the process water varies as it is fed long the path of the primary loop. This is represented by the lettered points on the primary and three exemplary secondary loops in FIG. 6. Consider for example a hotel with rooms being cooled to a common temperature. The pressure drop from B to C of the first station would be 60 to 30, the pressure drop across the second loop from D to E would be 55 to 35, and the pressure drop across the third loop would be 50 to 40. In such situation, the supplemental controller for each loop would be programmed to accommodate the varying pressures of the various secondary loops as measured along the primary loop.

In addition to varying operating parameters for different sites of a system, it has been found that different operating parameters may also be required by variations of load at different times. For example, the settings for varying valve openness at each station would vary between summer to winter. In changing from one water bridge site to another, the valves for any one sight would be modified by the controller setting for such site. This relationship is shown in the graph of FIG. 7 which correlates the percent of openness of one valve with respect to the percent of openness of the other valve. The graphs of FIG. 7 illustrate one such condition for one site and how it could be varied as a function of its operating parameters.

| | |
|---|---|
| V-1 = Point A | Present maximum for flow desired in primary system relative to valve size and CV. (D) |
| V-1 = Point C | Valve moves to closed position as programmed in respect to V-2, point (B) |
| V-Z = Point B | Present maximum for flow desired in secondary system for optimum CV (E) in cross over at system minimum load |

Points A & B are field adjustable to suit system.

The leaf shaped curves, an upper curve and a lower curve, are defined by points O,B,C,A,O and represent the potential operating envelope for the flow system. Such curves are illustrated on a graph with the vertical component representing the percent of system flow (% flow) from zero to 100 percent. The horizontal component of the graph is the percent of maximum pressure drop (PD) across any water bridge. Maximum pressure drop (PD) extends from zero to 100 percent. At full flow, such is represented by line D-A. The operation of valve V-1 is represented by the point A. At a reduced flow, represented by line E-B, the operating range for the valve is defined by the line A-E. With feedback on the flow rate, the operating range of the valve would be limited to operate within the A-E line. Also if V-2 opens to max point V-1 closes to stop unwanted primary flow. This is simply one example of the system conditions affecting the operation of the valve. See concept points of FIG. 7.

In this primary embodiment, the means for varying the operating parameters of the controller components of the two associated valves is illustrated as a supplemental component of the common master controller MC adapted to modify and control the other controller components. The supplemental component may be replaced as required for a particular application or operating parameters. In the alternative, such supplemental component would be readily programmable through digital electronics.

In a further embodiment of the invention, the supplemental control element is by itself eliminated. In place thereof, electrical lines merely couple the temperature controller and pressure controller with the supplemental intelligence which represents the functional equivalent to the above described supplemental component. Such supplemental intelligence is built into the control elements for the temperature valve and flow valves. In such situation, the preferred technique for modifying the operating characteristics would be through a reprogramming of one or both of the control elements digitally.

The present invention is described with respect to controlling the flow and temperature of chilled water for use in cooling an air flow. It should be realized, however, that the present invention could be utilized for controlling the flow of other fluids, with the controlling being in response to other properties of the controlled fluid, and with the fluid being used for cooling, heating, or other functions.

The present disclosure includes that contained in the appended claims as well as that of the foregoing description. Although this invention has been described in its preferred form with a certain degree of particularity, it is understood that the present disclosure of the preferred form has been made only by way of example, and that numerous changes in the details of construction and combination and arrangement of parts may be resorted to without departing from the spirit and scope of the invention.

Now that the invention has been described, what is claimed is:

1. A system for controlling the flow of process fluids comprising:
   - a primary loop for process fluids;
   - a plurality of secondary loops for process fluids;
   - a plurality of bridges, each coupling the primary loop with a secondary loop, each bridge having feed and return connections coupled to the feed and return lines of the primary loop and feed and return connections coupling feed and return lines of a secondary loop, and a crossover line coupling the primary and secondary loops;
   - a flow responsive valve in the path of flow through the primary loop for each bridge and a flow sensor for each bridge to determine the flow in its crossover line for controlling the flow responsive valve;
   - a temperature responsive valve in the crossover line for each bridge and a temperature responsive sensor for each bridge responsive to the temperature of the process water;
   - a controller for each bridge adapted to modify its valves as a function of the sensed temperature and flow with means to limit the openness of one of the valve means as a function of the openness of the other of the valve means, each controller having a controller component for its flow sensor and a controller component for its temperature sensor.

2. The system as set forth in claim 1 wherein the controller components are variable as a function of the specific application of the system.

* * * * *